US007207439B2

(12) United States Patent
Casella

(10) Patent No.: US 7,207,439 B2
(45) Date of Patent: Apr. 24, 2007

(54) CONVERTIBLE MULTI-USE CONTAINER

(76) Inventor: Maria C. Casella, 815 West St., Harrison, NY (US) 10528

( * ) Notice: Subject to any disclaimer, the term of this patent is extended or adjusted under 35 U.S.C. 154(b) by 211 days.

(21) Appl. No.: 10/975,876

(22) Filed: Oct. 28, 2004

(65) Prior Publication Data

US 2006/0091036 A1 May 4, 2006

(51) Int. Cl.
*B65D 85/00* (2006.01)
*B65D 73/00* (2006.01)
*B65D 25/34* (2006.01)

(52) U.S. Cl. ..... 206/459.1; 206/457; 229/116.1

(58) Field of Classification Search ..... 206/459.1, 206/459.5, 457–458; 220/7, 62.14, 4.28–4.34; 40/312; 229/116.1; 446/72–77
See application file for complete search history.

(56) References Cited

U.S. PATENT DOCUMENTS 1,376,036 A * 4/1921 Pearsall ..... 220/4.28
1,544,463 A * 6/1925 Lengsfield ..... 206/459.5
1,698,731 A * 1/1929 Otto ..... 446/79
2,501,694 A * 3/1950 Ruffin ..... 229/116.1
3,849,917 A * 11/1974 Bergh et al. ..... 40/312
4,285,150 A * 8/1981 Richardson et al. ..... 40/312
4,402,397 A * 9/1983 Spence ..... 220/4.28
5,860,589 A * 1/1999 Hsu ..... 40/312
6,471,059 B2 * 10/2002 Purvis ..... 206/459.1
7,032,753 B2 * 4/2006 Purvis ..... 206/459.5

OTHER PUBLICATIONS

A Cup of Ideas, www.acupofideas.com; Card Boxes; 12" Acrylic Sequin & Pearls Card Box.
Sherman ; www.shop.com; Bridal Gift Card Box.
Wedding Accessories and Gifts; Enchantment, Elegant Bridal & Wedding Accessories; www.weddingtouch.com "Mailbox & Treasure Chest".
Wedding accessories and gifts -Enchantment-Card Boxes; www.candlelightmessage .com; Wedding Card Box Treasure Chest Design.
Money card and Money Holders; www.weddingaccessories.net/cardhold.htm "Church Card Holder".
Money card and Money Holders; www.weddingaccessories.net/cardhold.htm "Mail Box Holder".
Money card and Money Holders; www.weddingaccessories.net/cardhold.htm "Moiré Bridal Card and Money Box".
Money card and Money Holders; www.weddingaccessories.net/cardhold.htm "Brocade Bridal Card and Money Box".

(Continued)

*Primary Examiner*—Bryon P. Gehman
(74) *Attorney, Agent, or Firm*—Cohen Pontani Lieberman & Pavane LLP

(57) ABSTRACT

A multi-functional container includes at least three components: a box portion, a lid portion, and a cover portion. The cover portion includes one or more pieces removably affixed to, and/or removably supported by, the box portion. The box portion is adorned with one or more decorative designs appropriate for use in a first predesignated application, such as a child's toy box. At least one cover portion piece is adorned with one or more decorative designs appropriate for use in a second predesignated application, such as a wedding gift box.

10 Claims, 9 Drawing Sheets

OTHER PUBLICATIONS

Money card and Money Holders; www.weddingaccessories.net/cardhold.htm "Striped Satin Card Box".
Money card and Money Holders; www.weddingaccessories.net/cardhold.htm "Brocade Card Box".
Money card and Money Holders; www.weddingaccessories.net/cardhold.htm "Oval Card Box".
Money card and Money Holders; www.weddingaccessories.net/cardhold.htm "Wedding cake Card Holder".

* cited by examiner

REAR VIEW

CONVERTIBLE MULTI-USE CONTAINER

BACKGROUND OF THE INVENTION

1. Field of the Invention

The invention relates generally to a multi-functional container and, more specifically, to a multi-functional container that may be converted by addition, removal, or rearrangement of certain parts, from a container for use in a first application to a container for use in a second application.

2. Description of the Related Art

It is customary for the host of a wedding reception or other function to provide a designated location at which guests may place gifts. Typically, gifts are placed on a designated table where they remain until the reception or function is over. Larger items, such as boxed and wrapped gifts, may be left on the table for extended periods of time without substantial risk of theft or loss. On the other hand, envelopes containing cash or checks are easily misplaced or stolen. To address the problems raised by presentation of gifts in envelopes, it has become customary to provide a box or other type of receptacle into which wedding guests may deposit the envelopes they bring to the reception for the bride and groom.

Similarly, a receptacle for gift cards may be employed at other types of events or functions, such as bar-mitzvahs, holiday parties, anniversary celebrations, and birthday parties. In some instances, a box may be employed for the storage and distribution of party favors to the host's guests, to hold small gifts, or to function as a table centerpiece for the event.

It is customary for a woman to keep, and to use throughout her life, items received as wedding gifts and items that otherwise relate to her wedding day. A woman may keep, in a box in her bedroom, various types of items having sentimental value. A box used for this purpose is often referred to as a "keepsake" box.

It is also customary to place a box in a child's bedroom, even when the child is very young, for the storage of toys and other objects. When the child is very small, the box may be used for storing diapers, lotions, baby powder, and other items related to the care of the baby. When the child is older, the box may function as toy box, for use by both parent and child, for the storage of toys.

Furthermore, it is customary for a mother to desire to share with a child items that she once used, or that are of sentimental value to her, such as jewelry, furniture or a keepsake box that was once hers.

SUMMARY OF THE INVENTION

The present invention provides a multi-functional container that is convertible, by addition, removal, or rearrangement of certain parts, from a container for use in a first application to a container for use in a second application. The first application is at least one of an ornamental gift receptacle box and a wedding box, and the second application is at least one of a keepsake box that is used for storing memorabilia related to one's wedding day and a toy box that may be passed down from parent to child. The multi-functional container is converted from an ornamental gift receptacle box to at least one of a toy box and a keepsake box by removing one or both of a cover portion and a lid portion from the container.

Other objects and features of the present invention will become apparent from the following detailed description considered in conjunction with the accompanying drawings.

It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Throughout the drawings, like reference numerals are used to designate like elements.

DETAILED DESCRIPTION OF THE PRESENTLY PREFERRED EMBODIMENTS

Figure 1:
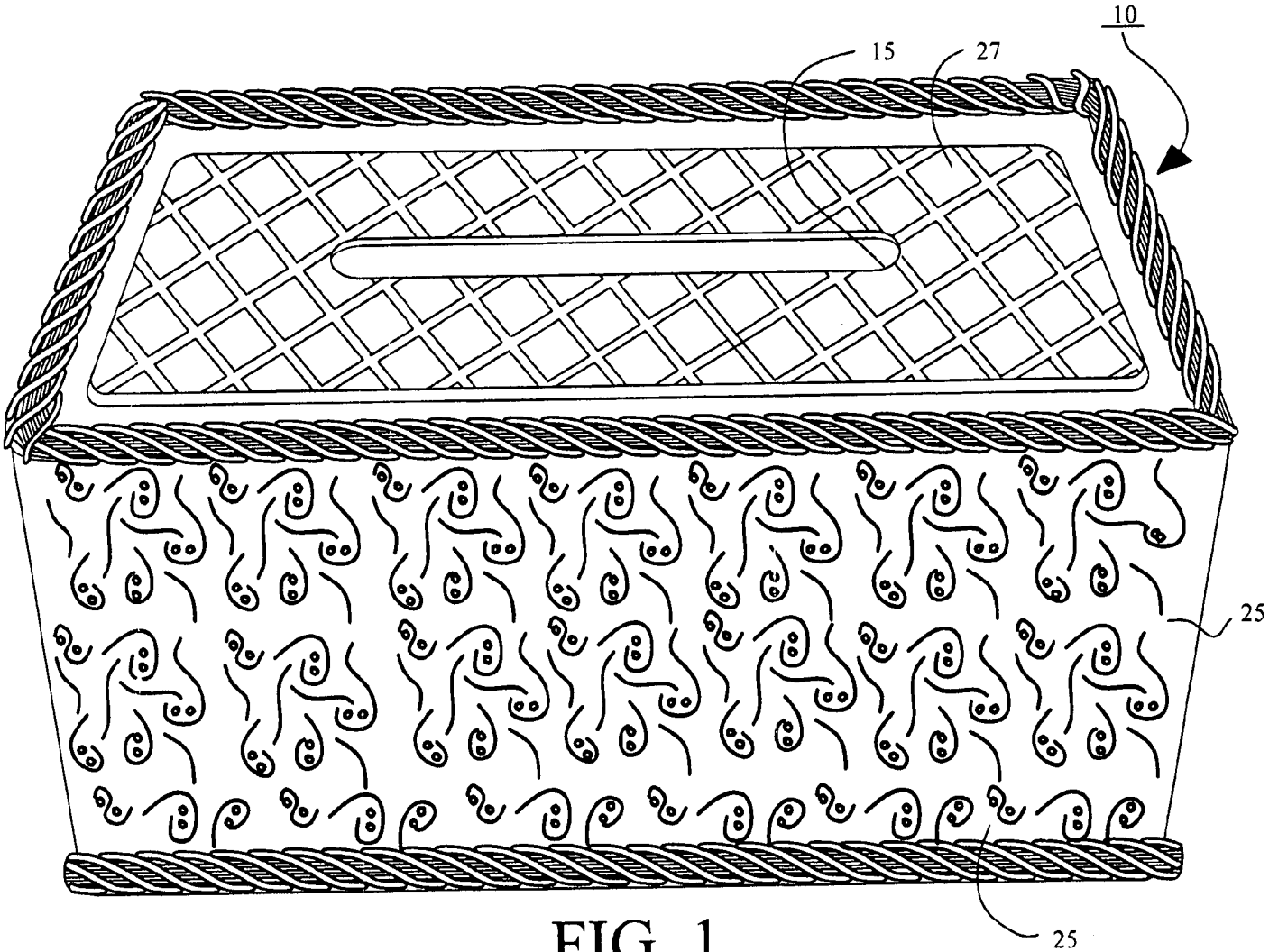
FIG. 1 is a perspective view of a multi-functional container with a cover portion and a lid portion installed for use as a bridal gift-receptacle box in accordance with a preferred embodiment of the present invention.
Figure 2:
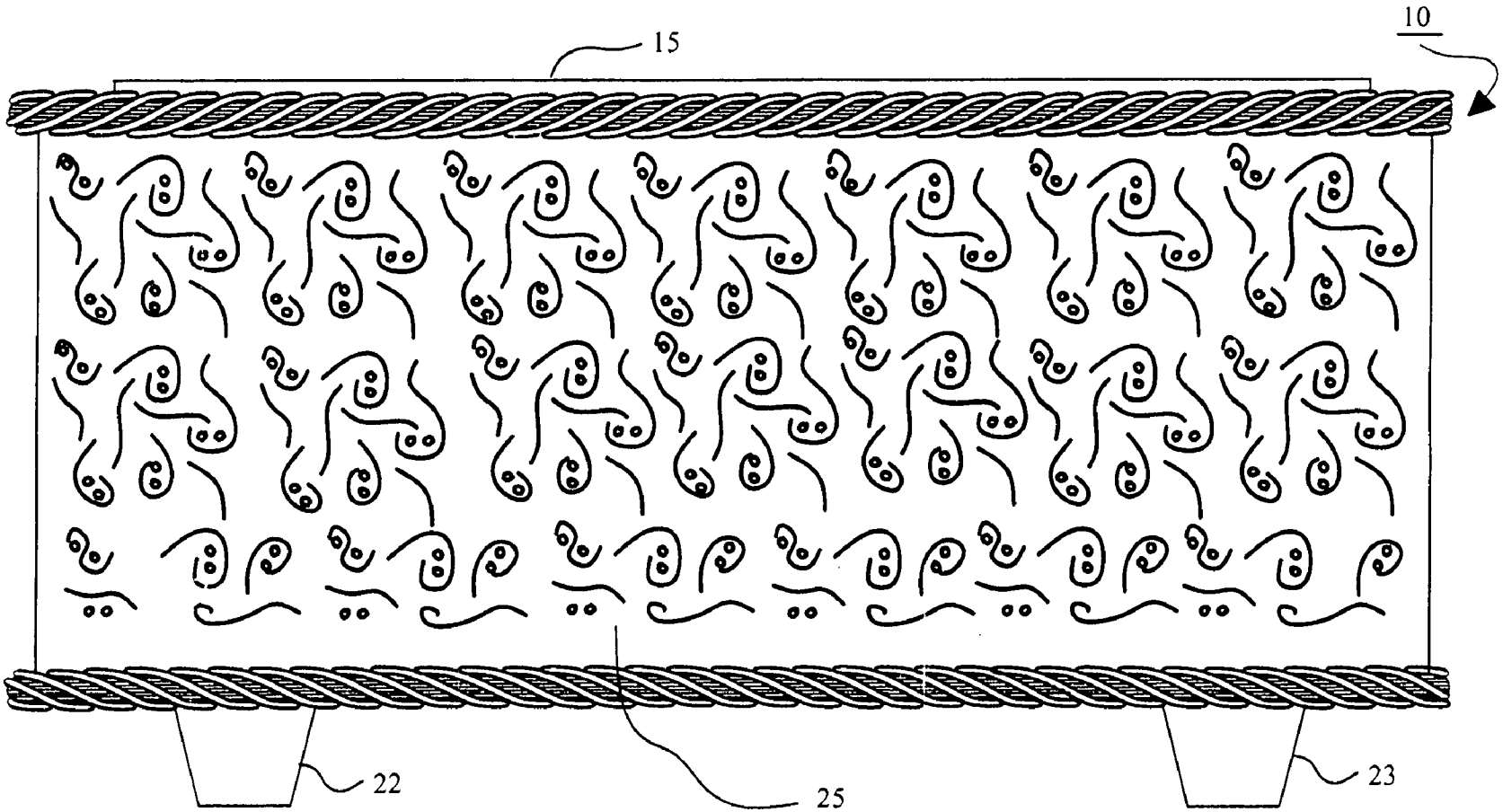
FIG. 2 is a front view of the multi-functional container of FIG. 1.
Figure 3:
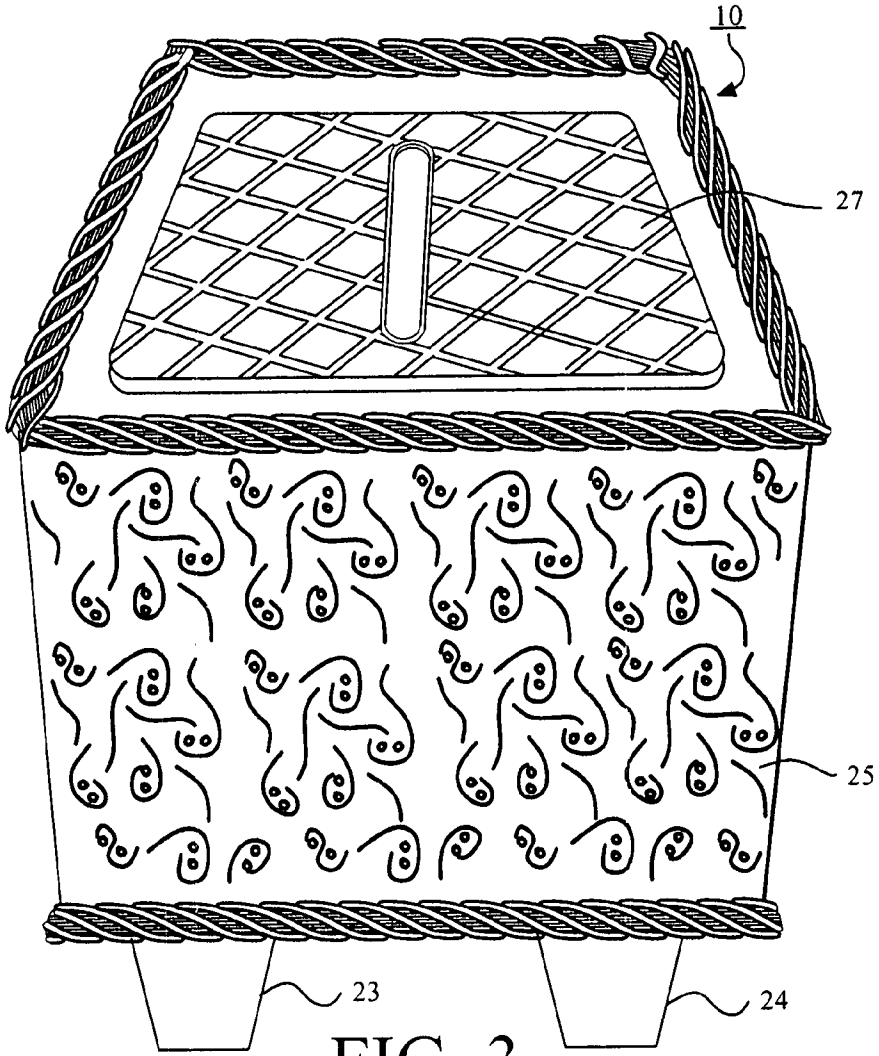
FIG. 3 is a side perspective view of the multi-functional container of FIG. 1.

In overview, the present invention provides a multi-functional container that is convertible, by addition, removal, or rearrangement of certain parts, from a container for use in a first application to a container for use in a second application. As shown in FIGS. 1–3, the first application may be at least one of an ornamental gift receptacle box and a wedding box. With reference to FIGS. 5–8, the second application may be at least one of a keepsake box that is used for storing memorabilia related to one's wedding day and a toy box that may be passed down from parent to child. The multi-functional container may be converted from an ornamental gift receptacle box or a wedding box to at least one of a toy box and a keepsake box by removing one or both of a cover portion (FIG. 5) and a lid portion (FIGS. 4–7) from the container.

Figure 5:
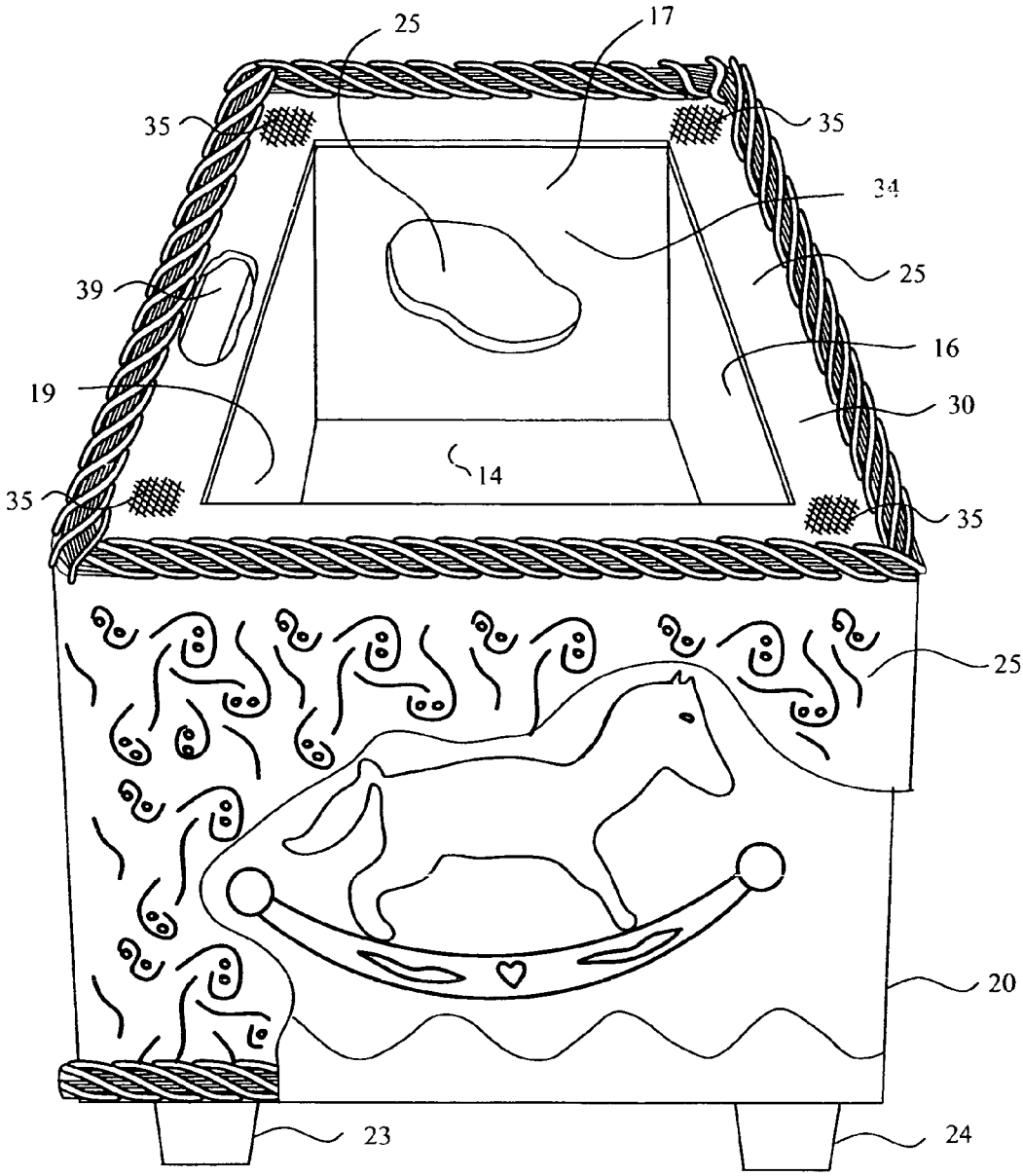
FIG. 5 is a cutaway side view of the multi-functional container of FIGS. 1 and 3 showing the cover portion partially cut away from the multi-functional container so as to partially reveal an underlying toy box.
Figure 7:
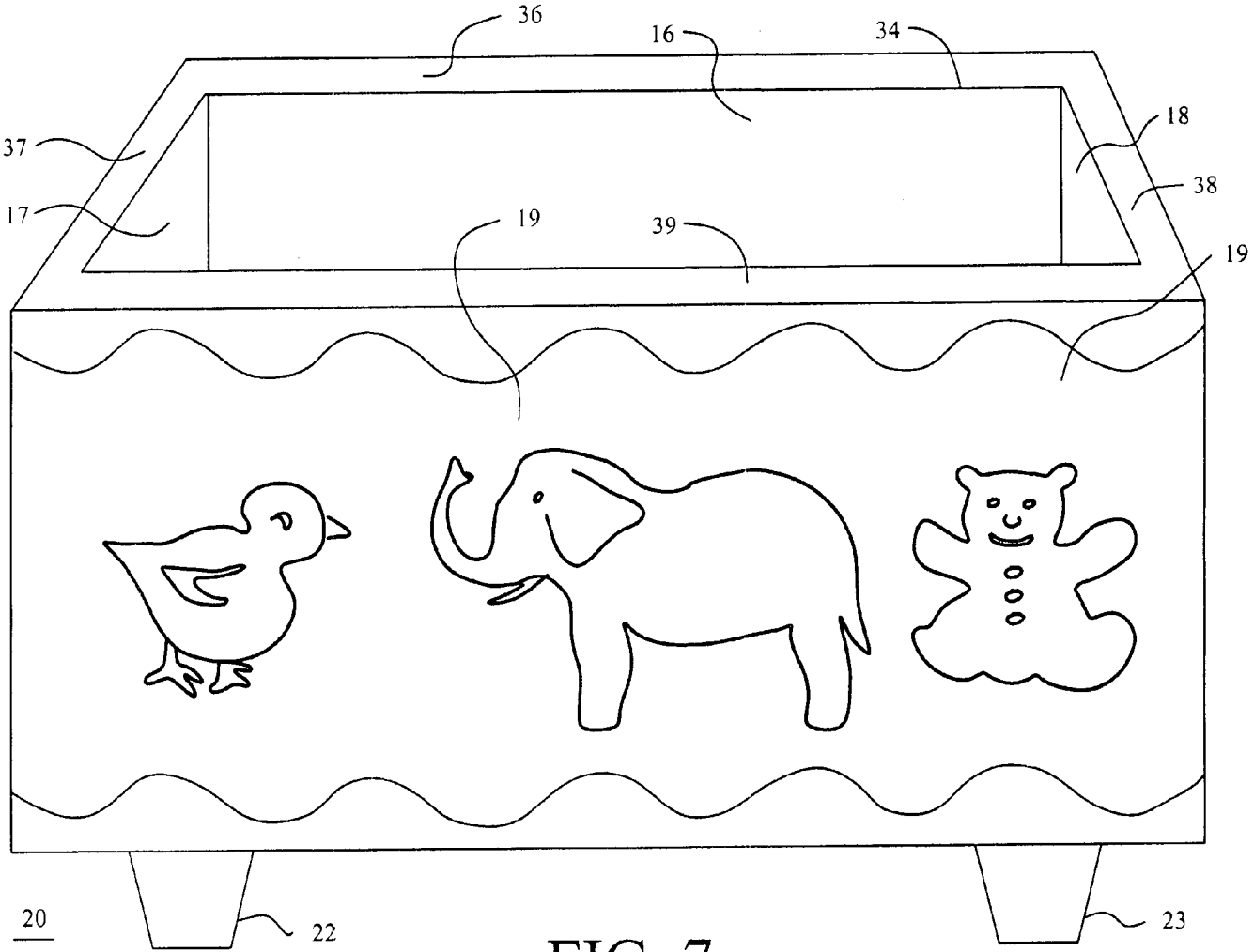
FIG. 7 is a perspective view of the multi-functional container of FIG. 1 wherein the cover portion and the lid portion have been removed so as to convert the container for use as a toy box.
Figure 8:
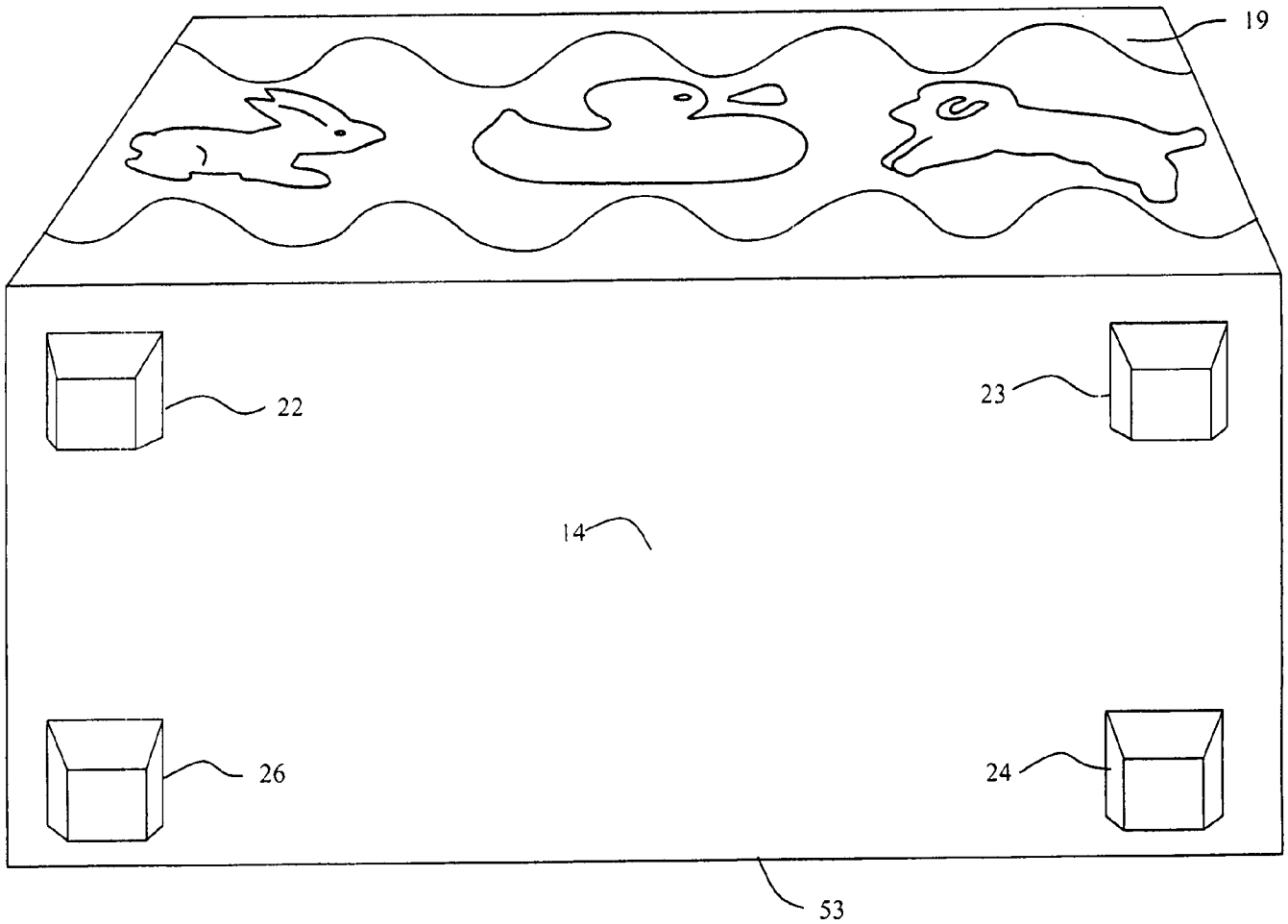
FIG. 8 is a bottom view of the multi-functional container of FIG. 7.

FIG. 1 is a perspective view of a multi-functional container 10 with a cover portion 25 and a lid portion 15 installed for use as a bridal gift-receptacle box. FIG. 5 is a cutaway side view of the multi-functional container 10 of FIG. 1, showing cover portion 25 partially cut away from multi-functional container 10 so as to partially reveal an underlying box 20. Cover portion 25 includes one or more pieces that are either permanently or removably affixed to, and/or supported by, underlying box 20. FIG. 7 is a per spective view of the multi-functional container 10 of FIG. 1 wherein the cover portion 25 (FIG. 1) and the lid portion 15 (FIG. 1) have been removed so as to convert the container for use as a toy box or keepsake box. Accordingly, underlying box 20 may be adorned with one or more decorative designs appropriate for at least one of a child's toy box and a keepsake box. Alternatively, underlying box 20 may be furnished without such decorative designs, but with a kit of decorative materials, wherein such designs are applied by a purchaser or user. In a similar manner, cover portion 25 and lid cover 27 are adorned with one or more decorative designs appropriate for use on an ornamental gift receptacle box or a wedding box. Alternatively, cover portion 25 and lid cover 27 may be furnished without such decorative designs, but with a kit of decorative materials, with which designs may be applied by a purchaser or user.

Underlying Box 20

Underlying box 20 (FIGS. 5 and 7) functions as the main body of the multi-functional container. Underlying box 20 may be fabricated of wood, glass, ceramic, polymeric resin, cardboard, polystyrene or any other suitably rigid material. Underlying box 20 includes at least three sides 16, 18, 19. Sides 16, 18, 19 may all adjoin a box bottom 14, if underlying box 20 has a bottom. Alternatively, sides 16, 18, 19 may be joined to one another in any suitable manner so as to effectively contain any article that is placed inside underlying box 20. Underlying box 20 may include a flat bottom 14, so as to enable resting the multi-functional container on a flat surface such as a table.

Alternatively or additionally, there may be a pedestal-type appendage attached to the bottom of underlying box 20, or three or more legs 22, 23, 24, 26 (FIG. 8) attached to bottom 14 of underlying box 20 to support the entire multi-functional container in a position elevated above the level of the table or other surface on which the multi-functional container rests. Alternatively, there may be holes, slots, grooves, indentations, or attachment hardware on bottom 14 or on one or more sides 16, 18, 19 to enable the multi-functional container to be attached to a pedestal, stand or other structure for supporting the multi-functional container, elevating the multi-functional container from a table or floor, or mounting underlying box 20 to a wall or other structure or object. In a preferred embodiment, underlying box 20 is provided with four legs 22, 23, 24, 26, each leg attached to the underside of bottom 14 of underlying box 20, near a corner of bottom 14.

With reference to FIG. 7, underlying box 20 includes an opening 34 at or near top surfaces 36, 37, 38, 39. The size and shape of opening 34 may correspond to the size and shape of bottom 14, if there is a bottom, or opening 34 may be of a different size, shape, or configuration. Opening 34 may be defined by one or more respective upper surfaces 36, 37, 38, 39, of one or more corresponding sides 16, 17, 18, 19, or may be formed from a cutout in one or more of the sides 16, 17, 18, 19. In an illustrative embodiment, the underlying box has three sides and no bottom. In another illustrative embodiment, shown in FIGS. 7 and 8, underlying box 20 has four sides 16, 17, 18, 19, a rectangular bottom 14 that adjoins a bottom edge of each of the sides 16, 17, 18, 19, and a rectangular opening 34 at the top that corresponds substantially in size and shape to the rectangular bottom 14.

Figure 9:
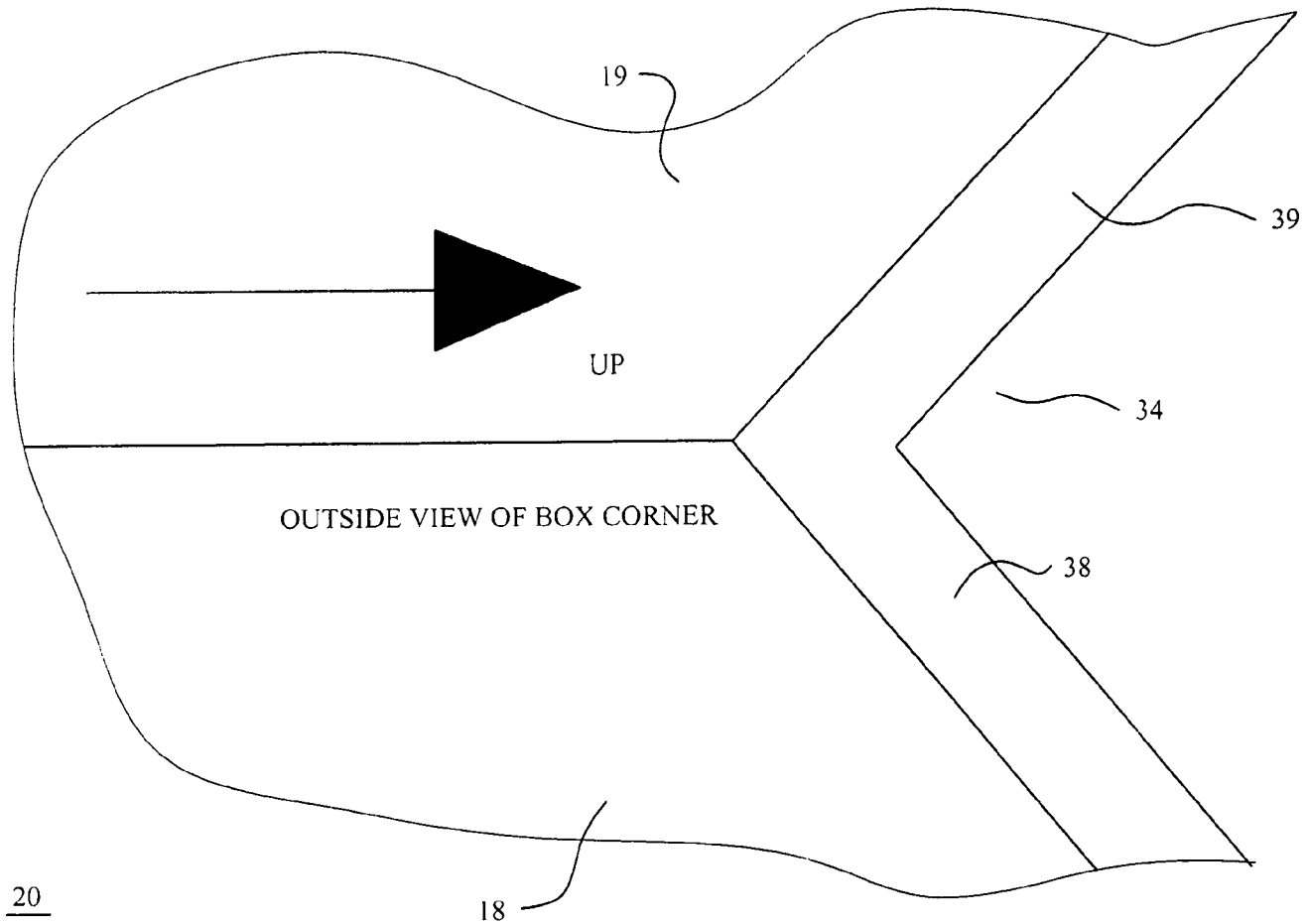
FIG. 9 is a perspective view of an outside corner of the multi-functional container of FIG. 7.

FIG. 9 shows further details of an outside corner of underlying box 20, representing the front upper right hand corner of the box shown in FIG. 7. Sides 18 and 19 (FIG. 9) meet to form an outside corner of underlying box 20, in a manner so as to form first and second upper surfaces 38, 39 for at least partially supporting cover portion 25.

Decorative Designs

The decorative designs on underlying box 20 may be created in any manner that is practicable given the material of which underlying box 20 is made. For example, in the case of a wooden box, designs may be painted on underlying box 20. In the case of a plastic box, the decorative designs may be applied in the form of adhesive decals, may be painted or applied with permanent ink to the plastic surface, or may be provided by adding colorant to at least a portion of the plastic material used to fabricate underlying box 20.

The decorative designs provided on underlying box 20 may be decorative designs that are suitable for use in any predesignated application and, illustratively, may include any of designs that are appropriate for a baby's nursery, designs that are appropriate for a keepsake box to be placed among fine furniture in a woman's bedroom, and designs appropriate for the bedroom of a grammar-school-age child. Pursuant to one preferred embodiment of the present invention, the decorative designs on the box portion will be designs of a type appropriate for display in the bedroom of an infant or toddler.

Pursuant to an alternative embodiment of the invention, underlying box 20 may be provided without decorative designs in place, but rather with instructions or instructions and materials to enable the consumer to apply decorative designs to the box.

Lid Portion

Figure 4:
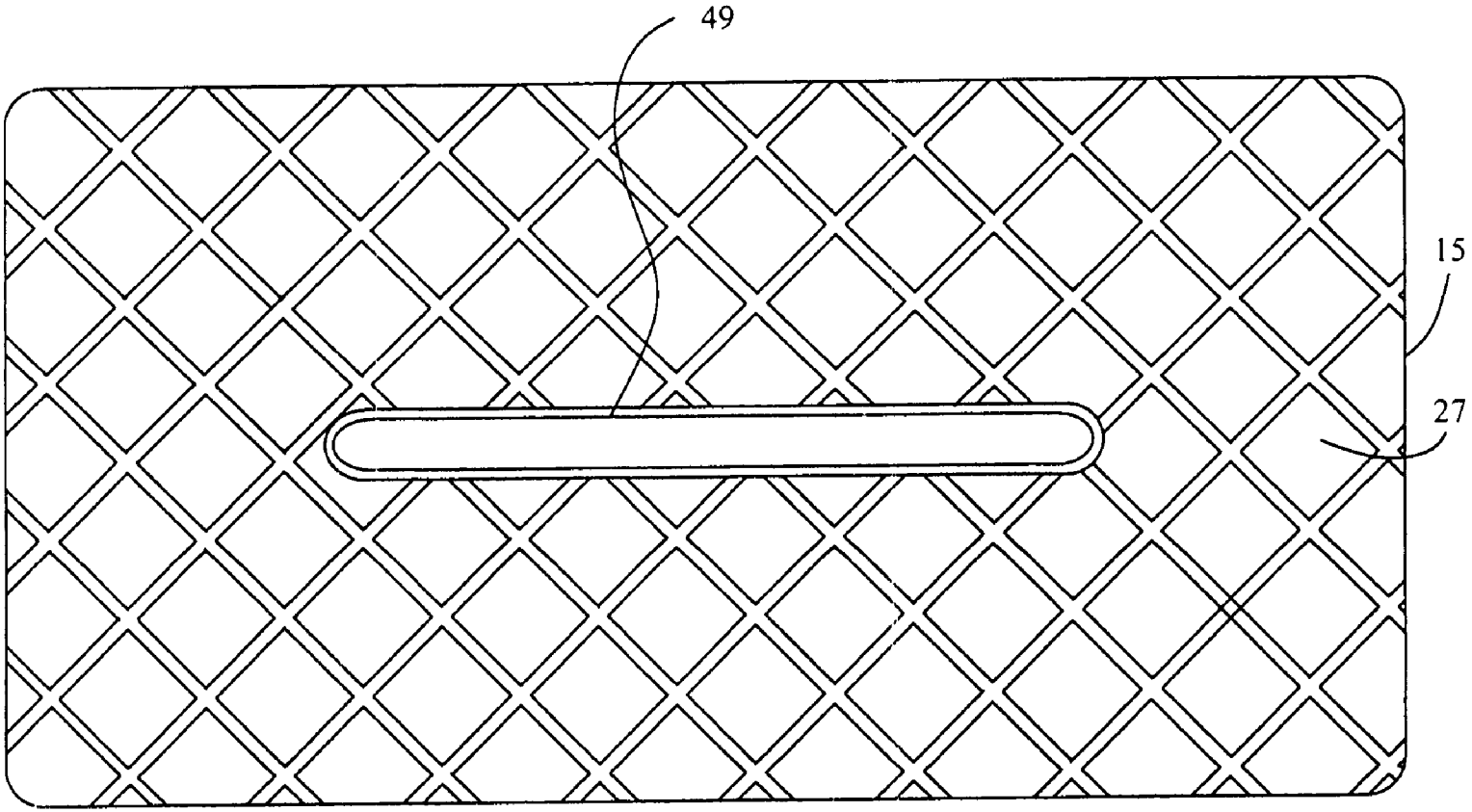
FIG. 4 is a top view showing the lid portion removed from the multi-functional container of FIG. 1.
Figure 6:
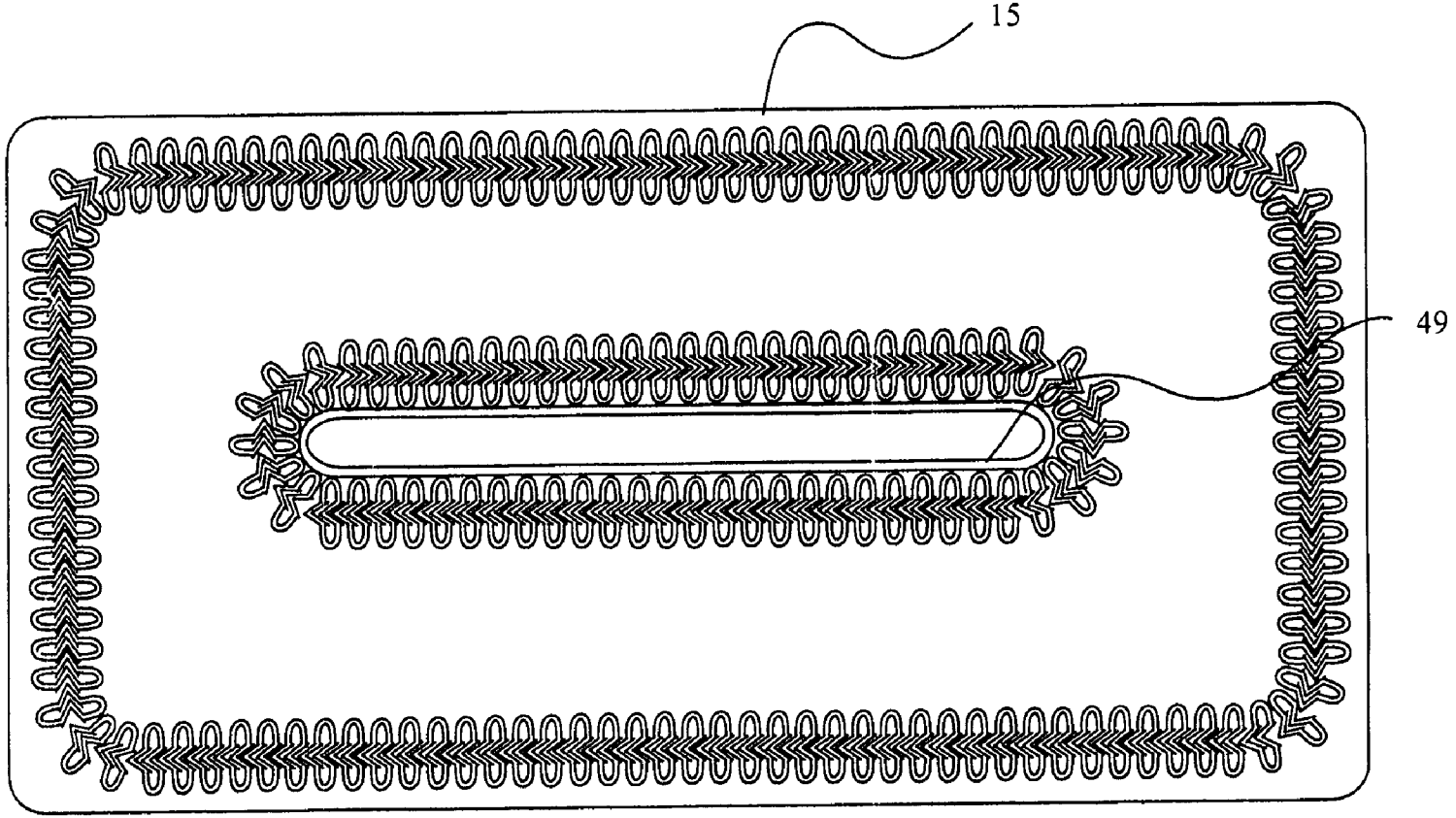
FIG. 6 is an underside view of the lid portion removed from the multi-functional container of FIG. 1.

With reference to FIGS. 4 and 6, lid portion 15 is fabricated of wood, glass, ceramic, polymeric resin, cardboard, polystyrene, or any other suitable rigid material. One purpose of lid portion 15 is to cover underlying box 20 to keep any box contents out of sight. Moreover, in some embodiments of the present invention, lid portion 15 contains a slotted opening 49 adapted for insertion of envelopes, cards, money, checks, and other flat-shaped gifts.

Lid portion 15 may optionally be attached to underlying box 20 with one or more hinges, may be attached to underlying box 20 by any other means that allows for hinge-like opening and closing of lid portion 15 while it remains attached to the box portion, or may be attached to underlying box 20 by means that allow the lid portion 15 to be locked in place atop underlying box 20 to provide for the security of the contents; or lid portion 15 may not be attached to underlying box 20 at all. Regardless of whether lid portion 15 is permanently attached to underlying box 20, there may be provided any number of hinges, latches, hasps, snaps, straps, Velcro® or other means to allow for the permanent or temporary fastening in place of all or some portion of lid portion 15 to underlying box 20.

With reference to FIG. 5, lid portion 15 may rest on a flange 30 of cover portion 25. Optionally, flange 30 may be equipped with one or more fastening mechanisms 35, including any of hinges, latches, hasps, snaps, straps, Velcro® or other means to allow for the permanent or temporary fastening in place of all or some portion of lid portion 15 to cover portion 25.

Optionally, lid portion 15 may bear decorative designs, or may be provided with instructions and materials to enable the consumer to apply decorative designs. Optionally, lid portion 15 may be equipped with a permanently affixed or removable lid cover 27 that bears decorative designs; or lid cover 27 may be provided with instructions and materials to enable the consumer to apply decorative designs. Lid portion 15 may also be furnished with an attachment mechanism to provide, in conjunction with a corresponding attachment mechanism on lid cover 27, means for attaching lid cover 27 to lid portion 15.

Cover Portion

With reference to FIG. 5, cover portion 25 is fabricated of any type of material that is suitable for use as a permanently affixed or removable cover for underlying box 20. Optional lid cover 27 is fabricated of any type of material that is suitable for use as a permanently affixed or removable cover for lid portion 15. The purpose of cover portion 25 is to provide a decorative appearance that is appropriate for use in an application that may include a particular type of occasion, such as a wedding. The desired decorative appearance may be achieved through the use of any type of fabric and/or trimmings, in any color or pattern. In cases where fabric is employed, the fabric portion of cover portion 25 may be filled with, e.g., a pillow-like filling, such as down, a synthetic filler material, or spongy foam rubber, or may consist of a single layer or multiple layers of any type of fabric. Cover portion 25 includes at least one of a semi-rigid frame and an attachment mechanism. The semi-rigid frame may be fabricated of wood, glass, ceramic, polymeric resin, cardboard, polystyrene, or any other suitable material. The attachment mechanism may be provided in the form of one or more buttons, snaps, straps, Velcro®, glue, staples or other mechanism arranged in such a way as to provide for either permanent or removable attachment of cover portion 25 to any of various parts of underlying box 20, which may bear corresponding attachment means. Cover portion 25 may include one, two, or more pieces, as may be necessary to attach appropriately sized and shaped parts of the cover portion 25 to underlying box 20. Optional lid cover 27 may include one or more pieces for adorning lid portion 15.

Pursuant to a preferred embodiment of the present invention, cover portion 25 includes bridal fabric and trimmings mounted on one or more outside surfaces of a plastic substrate sleeve that removably encloses at least a part of underlying box 20 to cover decorative designs on underlying box 20, and to the give multi-functional container an appearance appropriate for use at a wedding reception. In one embodiment, the upper edge of the substrate sleeve is bent inward to provide a lip that rests on one or more upper edges 36, 37, 38, 39 of underlying box 20 so as to support the sleeve in a position covering four sides 16, 17, 18, 19 of underlying box 20, and lid portion 15 is covered with a separate lid cover portion 27 that is made of a fabric that matches or compliments cover portion 25.

Cover portion 25 may include any type of fabric, in any color or pattern, so as to suit the taste and needs of the consumer. A cover bearing images of animated children's television or movie characters may, for example, be provided with a box that is to be used as a receptacle for cards, gifts or party favors at a child's birthday party. A cover bearing religious images may be appropriate for use at a bar-mitzvah or a first-communion party.

The drawings, as well as the foregoing description associated therewith, are not intended to be limiting, but merely exemplary in nature. Thus, the scope of the present invention is defined only by the accompanying claims. Various modifications of the inventive multi-functional container may be made without departing from the scope and spirit of this invention. While this invention has been described with reference to specific embodiments thereof, it shall be understood that the invention shall not be limited thereto or thereby, but that these embodiments have been described by way of illustration and not limitation.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, that the scope of this invention be limited only by the claims appended hereto.

I claim:

1. A multi-functional container comprising:

a box adorned with one or more first decorative designs appropriate for use in a first predesignated article-receiving application, said box having a bottom, at least one side wall, and a top defining a storage space, said top defining a first opening for receiving articles to be stored in said space;

a lid portion arranged and dimensioned for receipt on said box for at least partially covering said first opening; and a cover portion removably affixable to or removably supportable by the box portion, wherein said cover portion is adorned with one or more second decorative designs appropriate for use in a second predesignated article-receiving application, said one or more first decorative designs are covered by said cover portion when said cover portion is removably affixed to or removably supported by said box, and said cover portion defining a second opening at least partially superimposed on said first opening of said box for receiving articles to be stored in said space when said cover portion is removably affixed to or removably supported by said box, whereby said container is usable for receiving and storing articles in both said first and second predesignated article-receiving applications.

2. The multi-functional container of claim 1, wherein at least one of the first and the second predesignated applications is a social function.

3. The multi-functional container of claim 1, wherein the first predesignated application is a toy box.

4. The multi-functional container of claim 1, wherein the second predesignated application is a wedding reception.

5. The multi-functional container of claim 3, wherein the second predesignated application is a wedding reception.

6. The multi-functional container of claim 1, wherein said lid portion is attached to said box by hinges or other means allowing for the lid portion to be opened while remaining attached to the box.

7. The multi-functional container of claim 1, wherein the lid portion is not attached to the box, but is shaped so as to mate with the upper portion of the box.

8. The multi-functional container of claim 1, wherein the box includes at least three sides.

9. The multi-functional container of claim 1, wherein the cover portion includes two or more separate pieces, each including an attachment mechanism providing removable attachment to at least one of the lid portion and the box.

10. The multi-functional container of claim 1, wherein said lid portion also being arranged and dimensioned for receipt on said cover portion for at least partially covering said second opening.

* * * * *